US009561841B2

(12) United States Patent
De Marcellus

(10) Patent No.: US 9,561,841 B2
(45) Date of Patent: Feb. 7, 2017

(54) WATERWAY MARKER ILLUMINATING ASSEMBLY

(71) Applicant: Roland De Marcellus, Riviera Beach, FL (US)

(72) Inventor: Roland De Marcellus, Riviera Beach, FL (US)

( * ) Notice: Subject to any disclaimer, the term of this patent is extended or adjusted under 35 U.S.C. 154(b) by 0 days.

(21) Appl. No.: 14/730,633

(22) Filed: Jun. 4, 2015

(65) Prior Publication Data

US 2016/0355242 A1 Dec. 8, 2016

(51) Int. Cl.

| | |
|---|---|
| ***B63B 45/02*** | (2006.01) |
| ***F21V 21/30*** | (2006.01) |
| ***F21V 21/26*** | (2006.01) |
| *F21Y 113/00* | (2016.01) |

(52) U.S. Cl.

CPC ..... *B63B 45/02* (2013.01); *F21V 21/26* (2013.01); *F21V 21/30* (2013.01); *F21Y 2113/002* (2013.01)

(58) Field of Classification Search

CPC ..... B63B 45/02; B63B 45/00; B63B 51/00; B63B 49/00; B63B 2201/04; B63B 2201/08; F21V 21/26; F21V 21/30; F21V 99/00; F21Y 2113/002; F21Y 2115/30;F21Y 2113/10; F21Y 2113/13; B63C 9/21; G01C 5/00

See application file for complete search history.

(56) References Cited

U.S. PATENT DOCUMENTS

| | | | | |
|---|---|---|---|---|
| 3,851,166 | A * | 11/1974 | Kohler | B63B 45/02 362/198 |
| 5,448,235 | A | 9/1995 | O'Neill, Jr. et al. | |
| 5,646,907 | A | 7/1997 | Maccabee | |
| 6,019,489 | A | 2/2000 | Wiggerman | |
| 6,126,299 | A * | 10/2000 | Hypes | G01S 17/95 340/985 |
| 6,380,871 | B1 * | 4/2002 | Kaplan | H04B 10/11 340/555 |
| 6,737,971 | B2 | 5/2004 | Knaak | |
| 7,448,780 | B2 * | 11/2008 | Hurley | B60Q 1/0483 362/370 |
| 8,636,383 | B2 | 1/2014 | Riley et al. | |

* cited by examiner

*Primary Examiner* — Bao Q Truong

(57) ABSTRACT

A waterway marker illuminating assembly includes a base that has a top side and a bottom side. The bottom side is abutted against and attached to a boat. A post is attached to the top side and extends upwardly therefrom. A housing is attached to an upper end of the post distal to the base. A laser light emitter is mounted in the housing and emits laser light when the laser light emitter is turned on. The laser light emitter illuminates a waterway marker such that a boat operator can easily see the waterway marker.

4 Claims, 4 Drawing Sheets

WATERWAY MARKER ILLUMINATING ASSEMBLY

BACKGROUND OF THE DISCLOSURE

Field of the Disclosure

The disclosure relates to sign locating devices and more particularly pertains to a new sign locating device for assisting a boat operator in locating waterway markers during times of poor visibility.

SUMMARY OF THE DISCLOSURE

An embodiment of the disclosure meets the needs presented above by generally comprising a base that has a top side and a bottom side. The bottom side is abutted against and attached to a boat. A post is attached to the top side and extends upwardly therefrom. A housing is attached to an upper end of the post distal to the base. A laser light emitter is mounted in the housing and emits laser light when the laser light emitter is turned on. The laser light emitter illuminates a waterway marker such that a boat operator can easily see the waterway marker.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
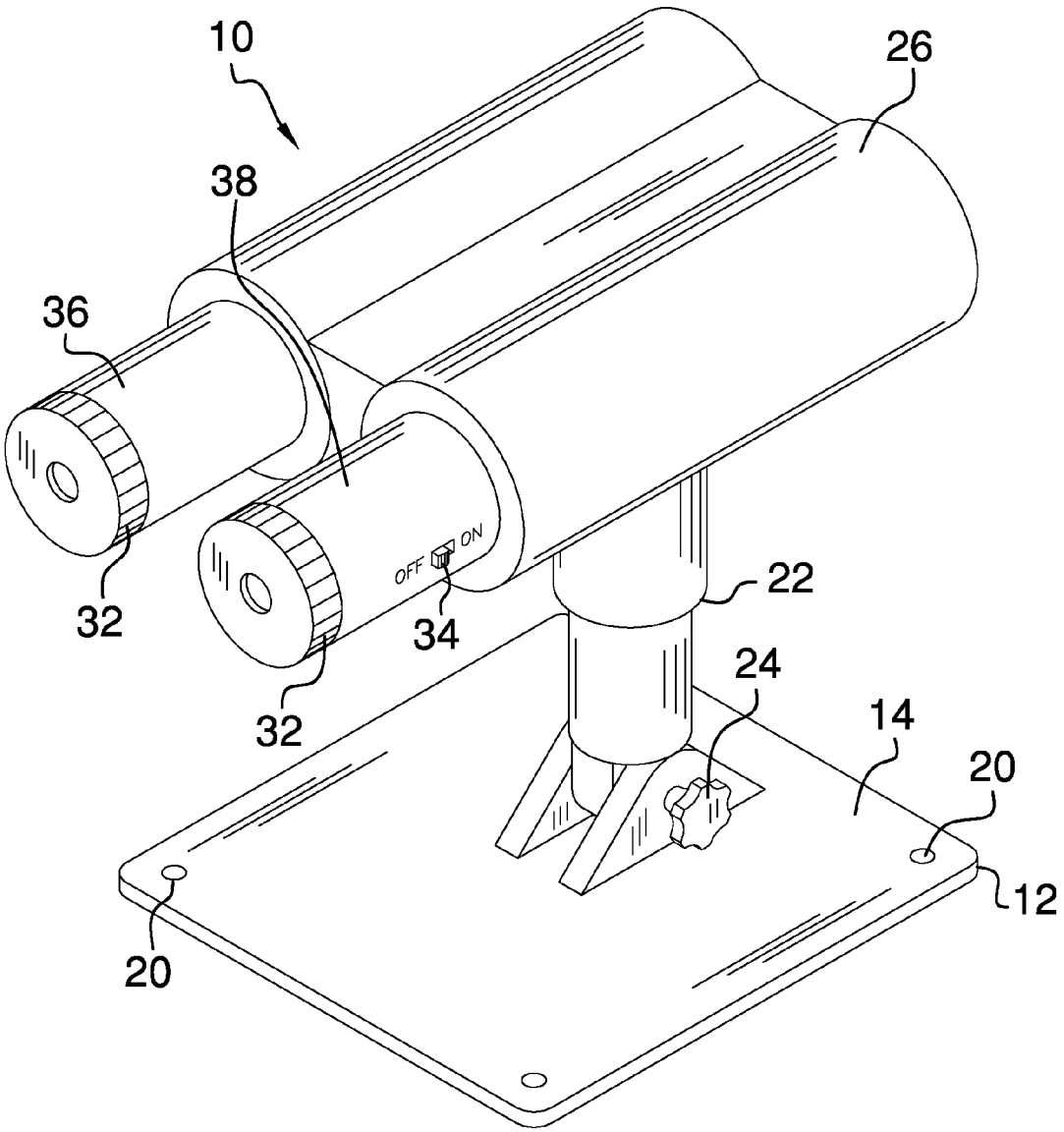
FIG. 1 is a perspective view of a waterway marker illuminating assembly according to an embodiment of the disclosure.
Figure 3:
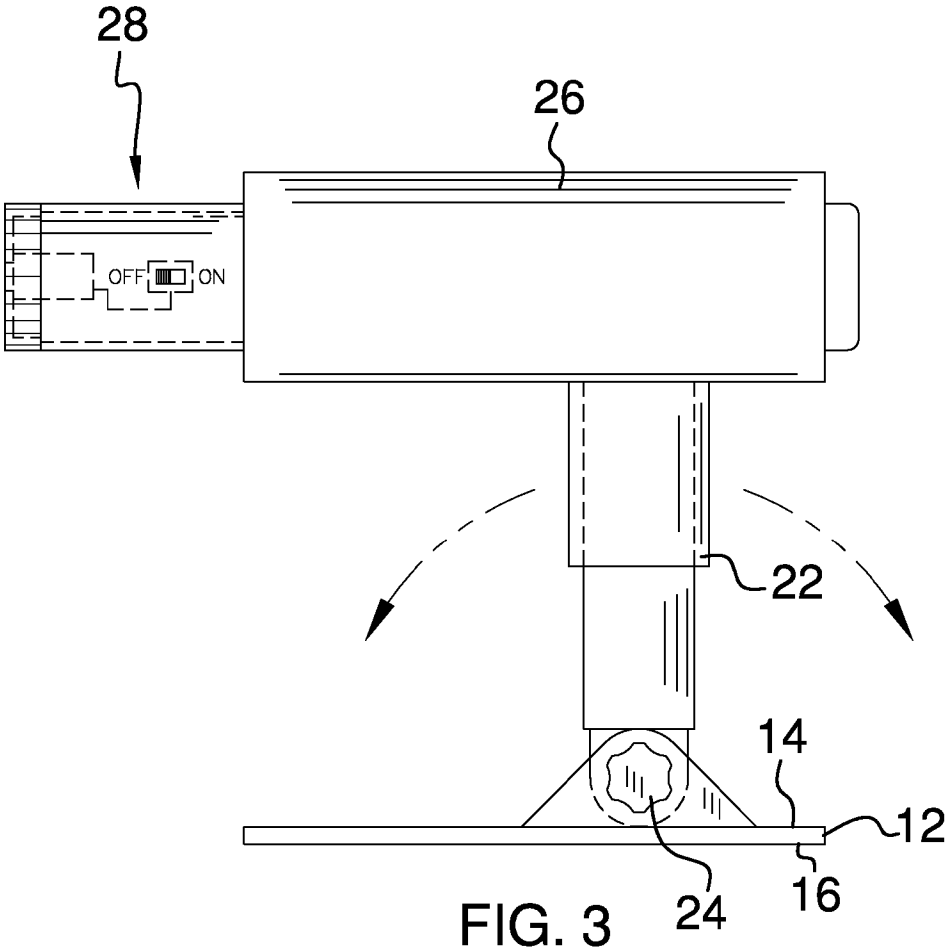
FIG. 3 is a side view of an embodiment of the disclosure.
Figure 2:
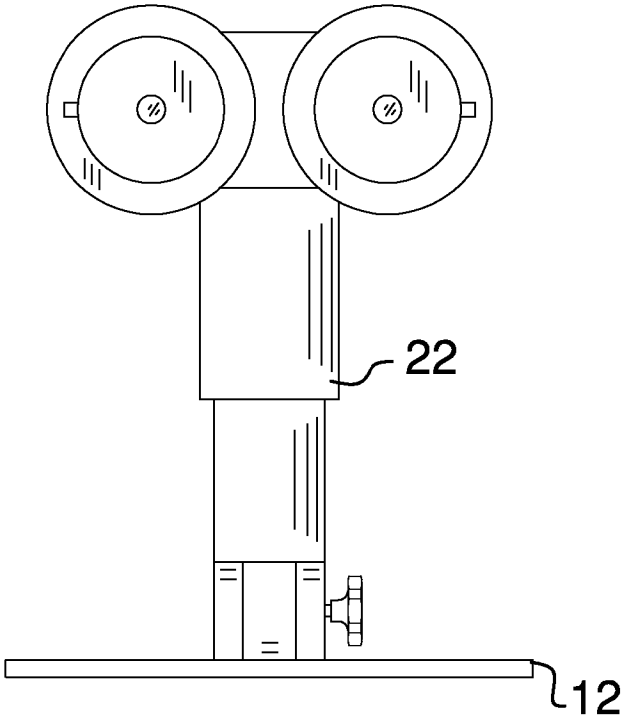
FIG. 2 is a front view of an embodiment of the disclosure.
Figure 4:
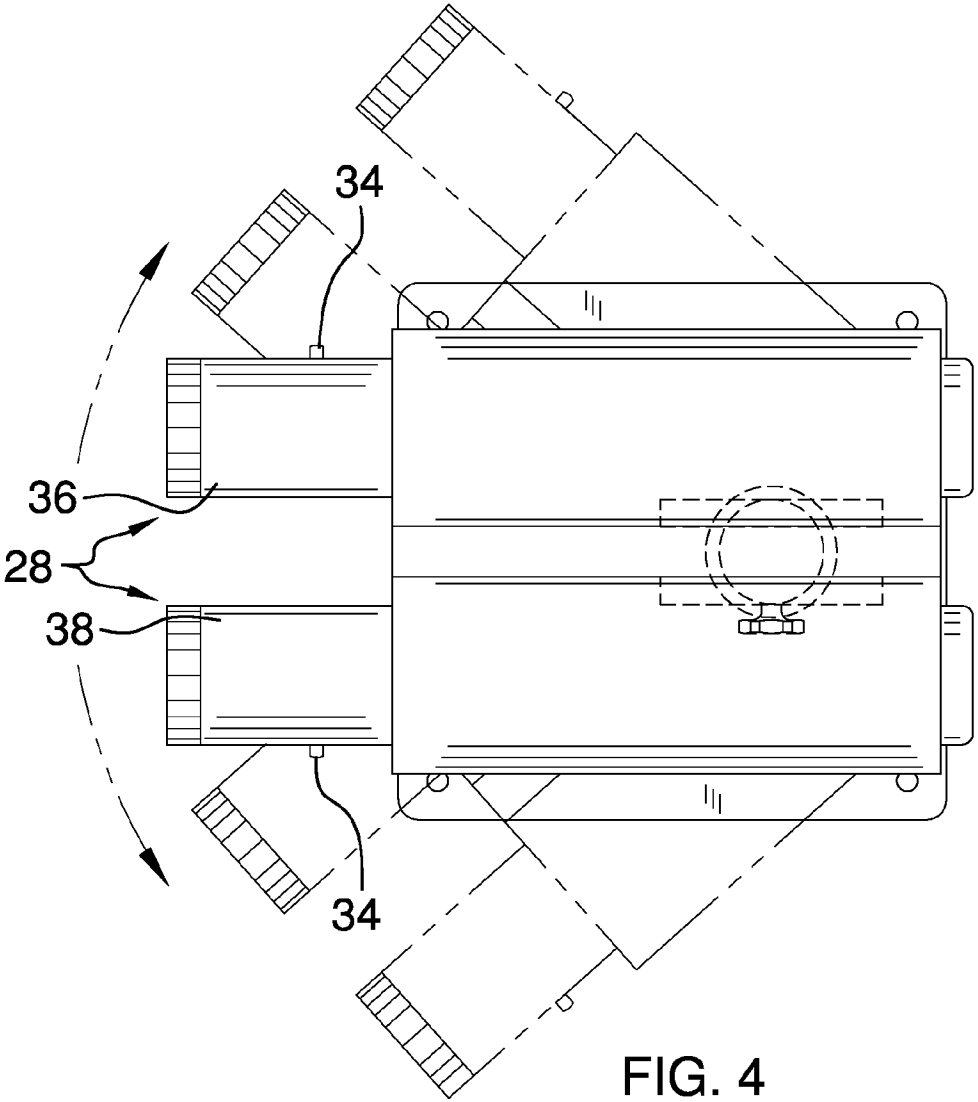
FIG. 4 is a top view of an embodiment of the disclosure.
Figure 5:
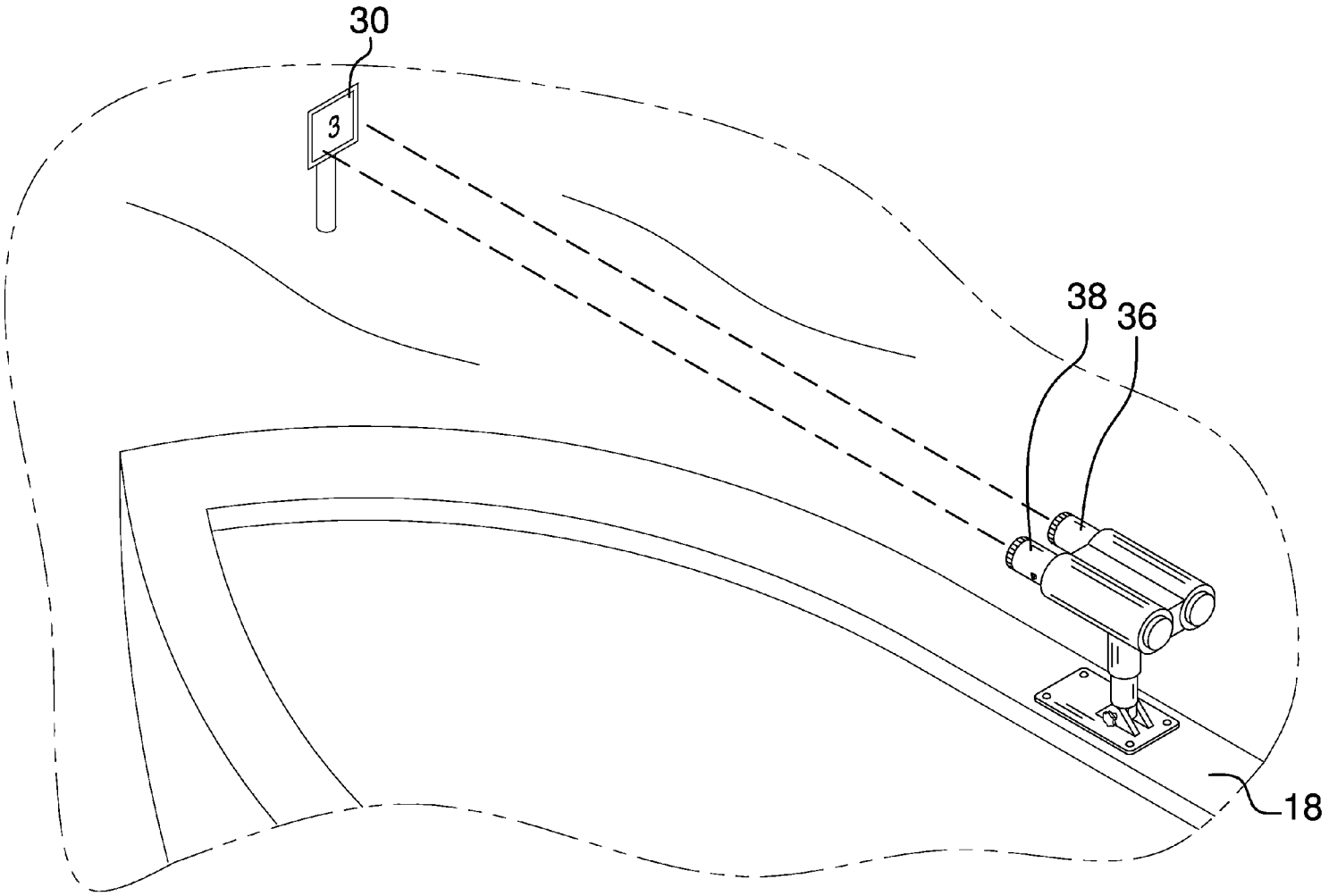
FIG. 5 is a perspective in-use view of an embodiment of the disclosure.

With reference now to the drawings, and in particular to FIGS. 1 through 5 thereof, a new sign locating device embodying the principles and concepts of an embodiment of the disclosure and generally designated by the reference numeral 10 will be described.

As best illustrated in FIGS. 1 through 5, the waterway marker illuminating assembly 10 generally comprises a base 12 that has a top side 14 and a bottom side 16. The bottom side 16 is configured to be abutted against and attached to a boat 18. This may be accomplished in a conventional manner such as fasteners that are extendable through apertures 20 in the base 12 and into the boat 18. The base 12 may comprise a plate comprised of a rigid material.

A post 22 is attached to the top side 14 and extends upwardly therefrom. The post 22 is pivotable with respect to the top side 12 and is prevented from pivoting with a locking fastener 24. Generally the post 22 will not be pivoted once the post 22 is vertically oriented such that it is perpendicular to the horizon. The post 22 may have a height between 3.0 inches and 12.0 inches.

A housing 26 is attached to an upper end of the post 22 distal to the base 12. The housing 26 is rotatable with respect to base 12 and rotated within a horizontal plane when the post 22 is vertically oriented. A conventional laser light emitter 28 is mounted in the housing 26 and emits laser light when the laser light emitter 28 is turned on. The laser light emitter 28 is configured to illuminate a waterway marker 30 such that a boat operator can easily see the waterway maker 30. The waterway maker 30 is typically any conventional sign placed within water to indicate changes in depth or objects that may be dangerous to boats in the areas. The laser light emitter 28 may include a focusing lens 32 to allow the laser light to be selectively widened or narrowed. The laser light emitter 28 may be powered in a conventional manner such as with a battery and include a switch 34 for turning the laser light emitter on or off.

The laser light emitter 28 may comprise a first laser light emitter 36 which is a red laser and a second laser light emitter 38 which is a green laser. Other colors may be provided as well. By utilizing two light colors the assembly 10 will function better in varying conditions. The first 36 and second 38 laser light emitters are oriented parallel to each other and are directed in a same direction with respect to each other.

The assembly 10 may also be used adjacent to a highest point on a boat to determine whether or not the boat will have clearance under a bridge which can be illuminated with the assembly 10.

In use, the assembly 10 is used in dark conditions or during times of poor visibility such as while boating in fog. The laser light emitter 28 will allow for seeing reflective waterway markers 30 during these times without using a spotlight which hinders the night vision of the boat operator and which does not work well in fog. The user of the assembly 10 will rotate the housing 26 to scan the horizon with the laser light emitter 28 to seek out the waterway markers 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A marker spotting assembly configured to assist a boat operator in locating waterway markers, said assembly comprising:

a base having a top side and a bottom side, said bottom side being configured to be abutted against and attached to a boat;

a post being attached to said top side and extending upwardly therefrom;

a housing being attached to an upper end of said post distal to said base;

a laser light emitter being mounted in said housing and emitting laser light when said laser light emitter is turned on, said laser light emitter being configured to illuminate a waterway marker such that a boat operator can easily see the waterway marker; and wherein said laser light emitter comprises a first laser light emitter comprising a laser of a first color and a second laser light emitter comprising a laser of a second color, said first and second laser light emitters being oriented parallel to each other and being directed in a same direction with respect to each other.

2. The marker spotting assembly according to claim 1, wherein said post is pivotable with respect to said top side.

3. The marker spotting assembly according to claim 1, wherein said housing is rotatable with respect to base.

4. A marker spotting assembly configured to assist a boat operator in locating waterway markers, said assembly comprising:

a base having a top side and a bottom side, said bottom side being configured to be abutted against and attached to a boat;

a post being attached to said top side and extending upwardly therefrom, said post being pivotable with respect to said top side;

a housing being attached to an upper end of said post distal to said base, said housing being rotatable with respect to base; and a laser light emitter being mounted in said housing and emitting laser light when said laser light emitter is turned on, said laser light emitter being configured to illuminate a waterway marker such that a boat operator can easily see the waterway marker, said laser light emitter comprising a first laser light emitter comprising a red laser and a second laser light emitter comprising a green laser, said first and second laser light emitters being oriented parallel to each other and being directed in a same direction with respect to each other.

* * * * *